US008205395B2

(12) United States Patent
Jakiel

(10) Patent No.: US 8,205,395 B2
(45) Date of Patent: Jun. 26, 2012

(54) WALL SYSTEM AND METHOD OF INSTALLATION OF A WALL SYSTEM

(76) Inventor: Gary G. Jakiel, Caledonia, MI (US)

( * ) Notice: Subject to any disclaimer, the term of this patent is extended or adjusted under 35 U.S.C. 154(b) by 379 days.

(21) Appl. No.: 12/589,858

(22) Filed: Oct. 29, 2009

(65) Prior Publication Data

US 2010/0122505 A1 May 20, 2010

Related U.S. Application Data

(60) Provisional application No. 61/110,377, filed on Oct. 31, 2008.

(51) Int. Cl.
*E04B 2/74* (2006.01)

(52) U.S. Cl. ..... 52/36.5; 52/36.6; 52/342; 52/387; 52/561; 52/568

(58) Field of Classification Search ..... 52/36.5, 52/36.6, 241, 242, 342, 343, 384, 387, 489.1, 52/489.2, 483.1, 561, 568, 578, 580, 588.1, 52/800.11, 800.12, 800.17
See application file for complete search history.

(56) References Cited

U.S. PATENT DOCUMENTS

| | | | | |
|---|---|---|---|---|
| 4,195,459 | A | 4/1980 | Anderson | |
| 4,196,948 | A | 4/1980 | Gavel et al. | |
| 4,292,776 | A | 10/1981 | MacDonald | |
| 4,603,068 | A | 7/1986 | Hunter | |
| 4,878,331 | A | 11/1989 | Taylor | |
| 4,961,295 | A | 10/1990 | Kosch, Sr. et al. | |
| 5,016,416 | A | 5/1991 | Munk | |
| 5,791,093 | A * | 8/1998 | Diamond | 52/36.5 |
| 5,819,490 | A * | 10/1998 | Current | 52/588.1 |
| D404,148 | S | 1/1999 | Laskowski et al. | |
| 5,941,026 | A | 8/1999 | Eisenreich et al. | |
| 6,134,846 | A * | 10/2000 | Lamb | 52/36.5 |
| D471,993 | S | 3/2003 | Holztrager | |
| D473,664 | S | 4/2003 | Perkins et al. | |
| 6,675,544 | B1 | 1/2004 | Ou et al. | |
| 6,772,569 | B2 | 8/2004 | Bennett et al. | |
| 7,464,511 | B2 | 12/2008 | Kosch | |
| 2003/0101611 | A1 | 6/2003 | Bueno | |
| 2004/0111980 | A1 | 6/2004 | Kosch | |
| 2008/0307739 | A1 * | 12/2008 | Clucas | 52/580 |
| 2009/0134290 | A1 * | 5/2009 | Begic et al. | 248/222.13 |

* cited by examiner

*Primary Examiner* — William Gilbert
*Assistant Examiner* — Patrick Maestri
(74) *Attorney, Agent, or Firm* — Flynn, Thiel, Boutell & Tanis, P.C.

(57) ABSTRACT

A wall panel system, which may be either a slat wall system or a smooth wall system, is provided. The system employs tongue and groove attachment means to conveniently attach the parts of the wall panel system to one another. A method of installing such a wall panel system is also provided.

17 Claims, 11 Drawing Sheets

WALL SYSTEM AND METHOD OF INSTALLATION OF A WALL SYSTEM

CROSS-REFERENCE TO RELATED APPLICATIONS

This claims priority to U.S. Provisional Patent Application No. 61/110,377, filed on Oct. 31, 2008 the entire disclosure of which is hereby incorporated by reference.

BACKGROUND OF THE INVENTION

Wall panel systems are used today in many residential and industrial settings. Such wall panel systems include panels attached to each other to create a wall covering which may be for aesthetic purposes, functional purposes, or both.

Such wall panel systems may result in a substantially flat, that is, smooth wall or may have indentions or grooves in it so as to create a functional wall such as a slat wall. Slat walls are walls consisting of a plurality of horizontal panel strips separated by slots or grooves. Brackets with hooks or other fasteners fit in the slots for suspending articles from the wall panel system. Typically, the brackets clip into place in the slots and are removable and repositionable.

A common slat wall system is formed of an extruded resin so that the slats and slots are integrally formed as a panel. The panels may have several slots spaced vertically along the panel. Panels are usually attached to walls or studs in a building frame by fasteners such as screws. Typically, these fasteners are visible, which is not desirable.

Mounting of a slat wall system to a wall is also sometimes a concern. Long, multi-slot panels are cumbersome and difficult to position, hold, and fasten to a wall all at the same time.

The present invention is an improvement in wall system construction. The improvement includes multiple parts that are attachable to one another in an easy fashion by using a tongue and groove system which not only assists in the ease of installation of the wall system, but also helps position the various pieces of the wall system both with respect to the structure the wall panel system is being installed upon, but also with respect to one another. The resulting wall system may either be a smooth wall or may include grooves to create a slat wall.

These and other features, advantages, and objects of the present invention will be further understood and appreciated by those skilled in the art by reference to the following specification, claims, and appended drawings.

Figure 1:
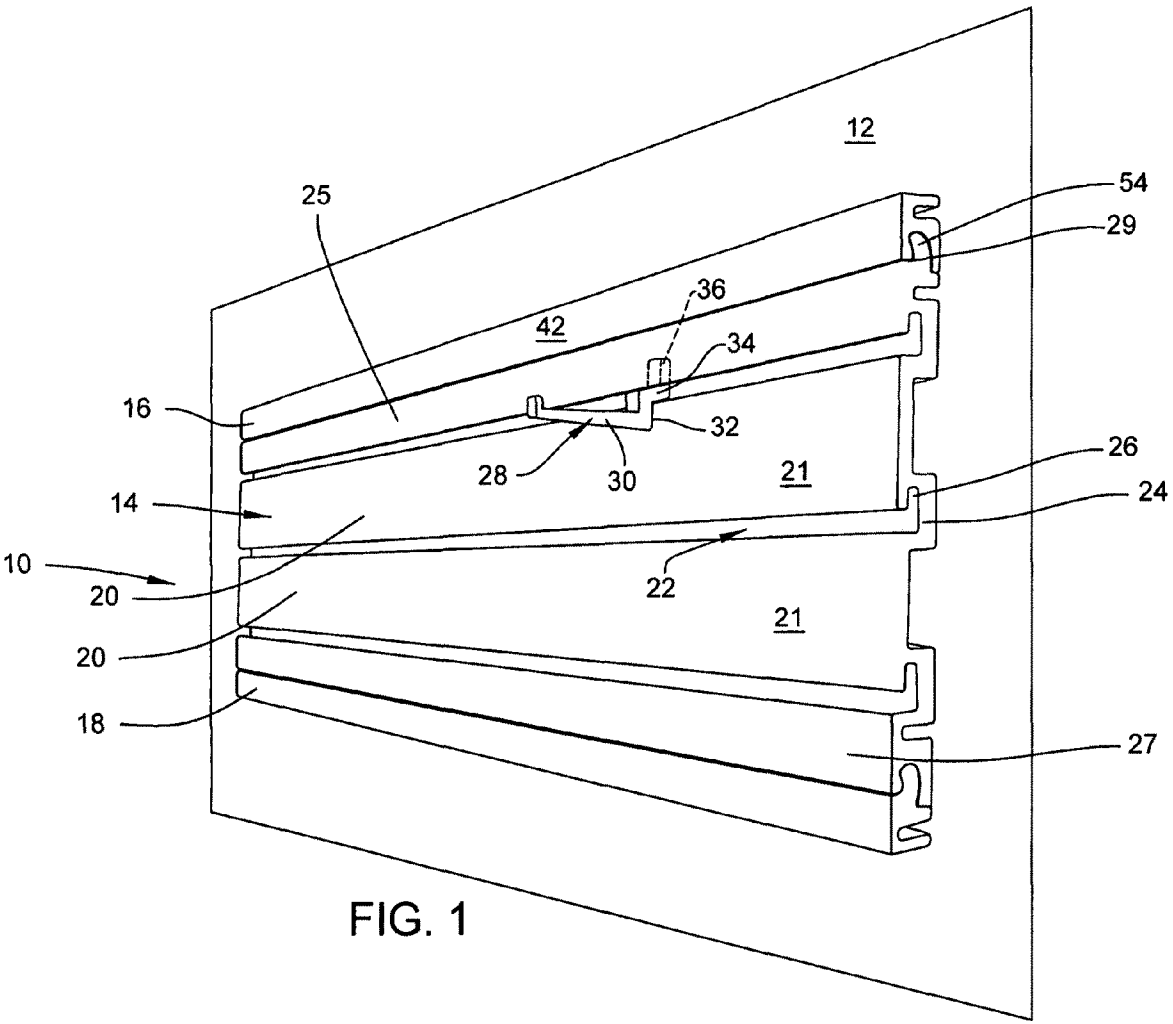
FIG. 1 is a perspective view showing a slat wall system of the present invention mounted on a wall.
Figure 2:
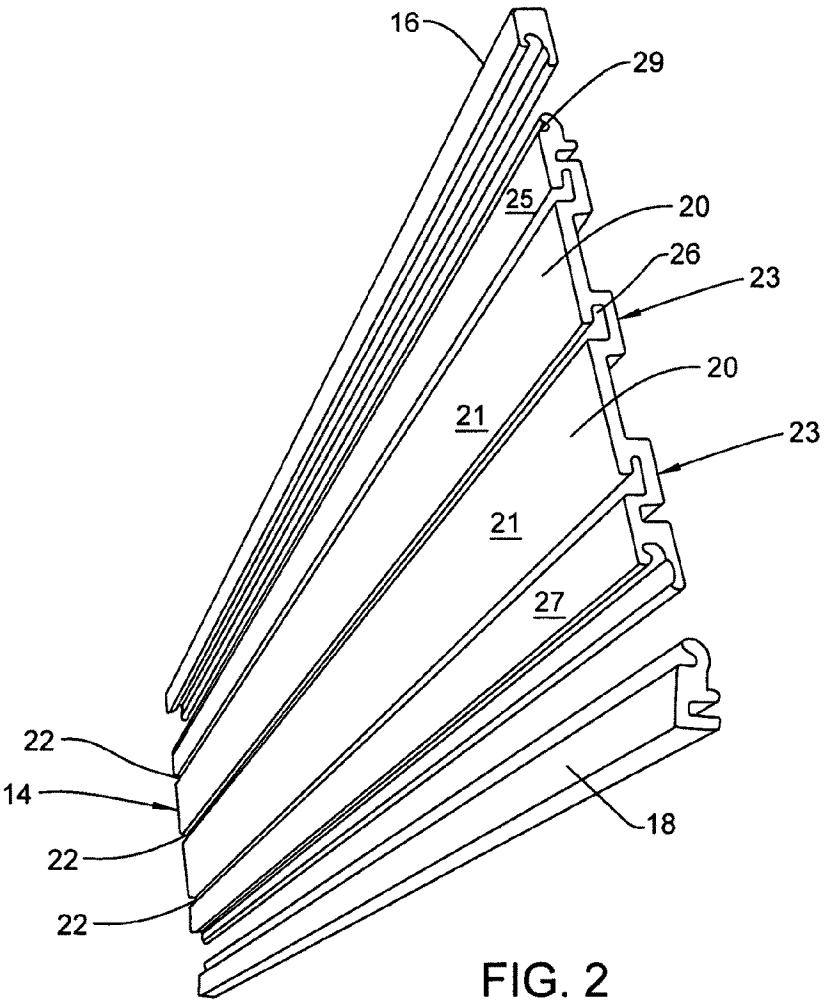
FIG. 2 is a perspective view showing the components of the slat wall system in a disassembled condition.

Certain terminology will be used in the following description for convenience and reference only, and will not be limiting. For example, the words "rightwardly," "leftwardly," "upwardly," and "downwardly" will refer to directions in the drawings to which reference is made, and specifically as the embodiment is oriented in FIG. 1. These terms will also be used with reference to directions which are perceived when the wall system is viewed in a normal upright assembled or disassembled condition. The terminology will include the words specifically mentioned, derivatives thereof, and words of similar import.

DETAILED DESCRIPTION OF THE PREFERRED EMBODIMENT

Referring to the drawings, a slat wall panel system 10 is shown in FIG. 1 mounted on a preexisting wall 12. Panel system 10 comprises a slat wall panel 14 connected at an upper edge to a mounting strip 16 and connected at a bottom edge to a trim strip 18. All of the panels are extruded members produced from synthetic resin, preferably PVC. A preferred resin is a PVC blend in a pellet or powder form.

Panel 14 comprises a plurality of raised slats 20 defining a front face 21 of the panel, and are separated by bracket mounting grooves 22 defined by a back wall 24 which also defines a back side 23 of the panel 14. The uppermost slat 25 and the lowermost slat 27 are approximately ½ the height of the other slats 21. Uppermost slat 25 has a shoulder 29 which defines an upper end of the panel 14. Panel 14 is preferably about ¼" to ¾" in thickness, from front face 21 to back side 23, and more preferably about ¾" thick, from front face 21 to back side 23. The material thickness is preferably approximately one third of the overall thickness of the panel; thus, for a ¾" thick panel, the material thickness is preferably about ¼" thick.

Grooves 22 extend inwardly from the vertical plane in which front face 21 is located to the back wall 24 and extend upwardly creating an upwardly extending portion 26 that is positioned behind the front face 21 of a slat 20.

Figure 7:
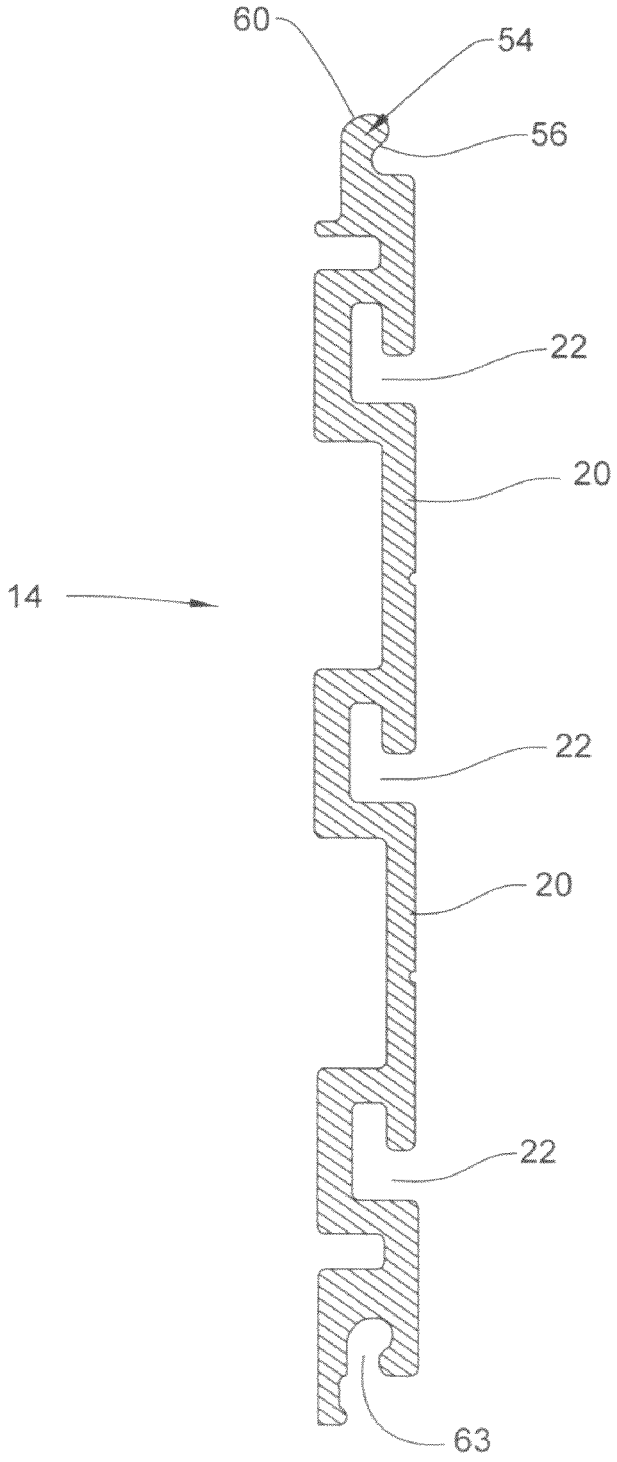
FIG. 7 is an edge elevational view of a slat wall panel of the present invention.

Brackets 28 fit in grooves 22 to suspend articles from the slat wall system. Bracket 28, shown for exemplary purposes in FIG. 1, includes an outwardly extending arm 30, a rear end 32 of the arm that abuts the front face 21 of slat 20, a rearwardly extending portion 34 that fits into groove 22, and an upwardly extending rear leg 36 that fits in upwardly extending portion 26 of the groove 22. Any number of different types of brackets for hanging various different objects can be suspended from the slat wall system of the present invention. Panel 14 further includes a curved tongue 54 which extends generally upwardly from the upper end of panel 14. Tongue 54 has a lower thinner portion 56 and an upper thicker head portion 60 (see FIGS. 5 and 7). Panel 14 also has a rear portion 61 which extends below the tongue to a short leg 62. The tongue 54 is shaped and sized to be received within an arcuate groove 48 of mounting strip 16, as discussed in more detail below.

While a single slat wall panel 14 is shown in FIG. 1, with the panel having three spaced grooves 22 therein, it should be understood that the slat wall panel system can include any number of slat wall panel members 14 attached to each other, and each panel 14 can be sized as needed with any number of slats and grooves.

Figure 5:
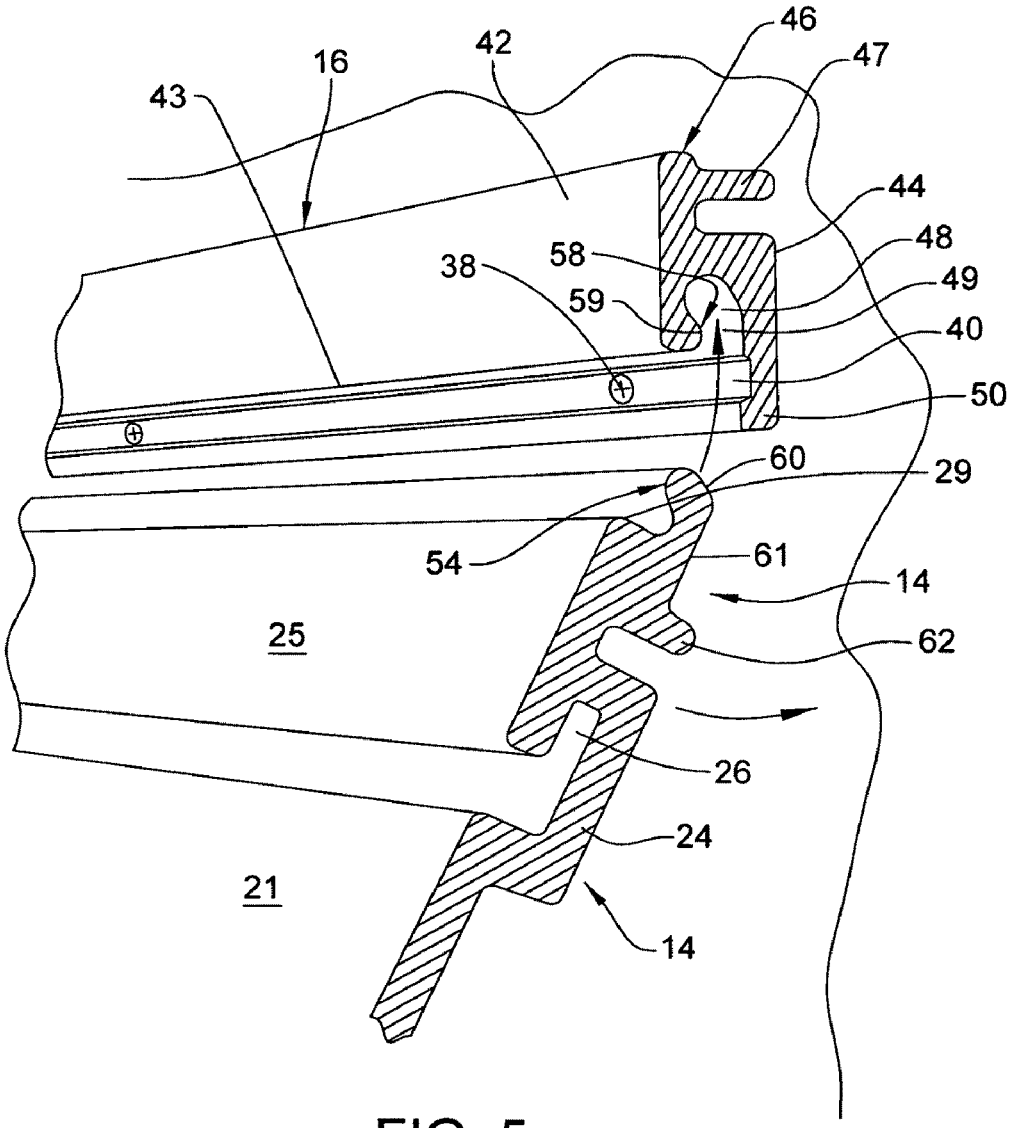
FIG. 5 is a fragmentary perspective view showing the mounting strip of FIG. 3 affixed to a wall with a slat wall panel being attached to the mounting strip.

The construction of the mounting strip 16 is shown in FIG. 5. Mounting strip 16 has a front face 42, a lower front edge 43, a rear surface 44, an upper surface 46, an extension arm 47, and arcuate groove 48 extending upwardly into the interior and slightly outwardly toward the front face 42 of the mounting strip. The arcuate groove 48 is preferably a different shape from grooves 22 of the panel 14 as they serve different functions. The mounting strip has a lower flange 50 with a recessed portion 40 that preferably extends the entire length of the mounting strip 16. The recessed portion 40 is preferably sized such that the head of a standard screw will fit therein, as shown in FIG. 5. The lower flange 50 extends to define a portion of arcuate groove 48 and downwardly below the lower edge of front face 42. Fasteners 38 such as screws extend through lower flange 50 in order to mount the mounting strip 16 to the wall or studs of a building frame, as described below. The groove 48, by extending toward front face 42, defines a concave portion 58 and a convex portion 59 in the areas of the groove 48 closest to front face 42.

Figure 6:
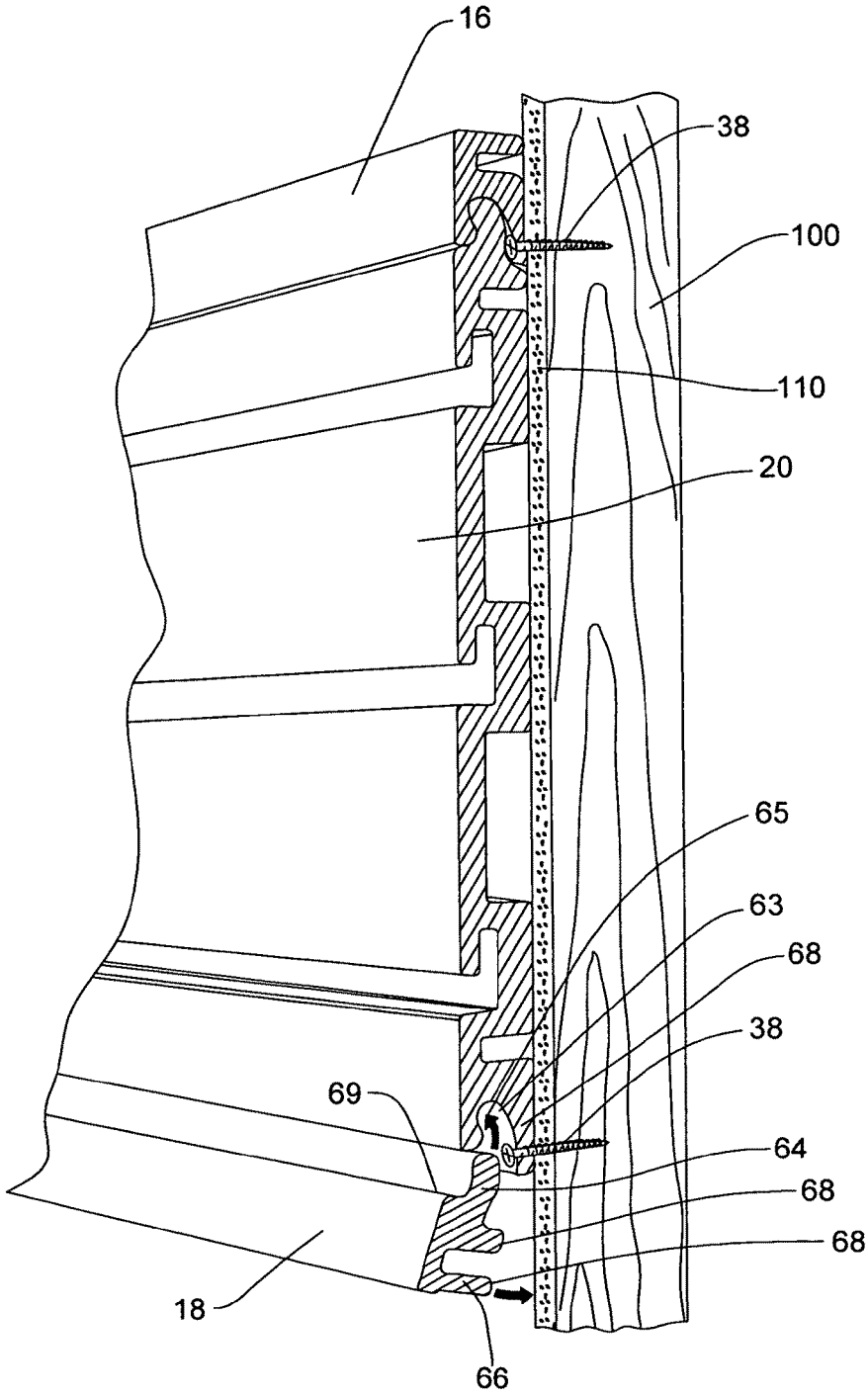
FIG. 6 is a perspective and partially sectional view of a slat wall panel system of the present invention mounted to wall studs, with a lower trim strip being attached to the panel system.

Trim strip 18 includes a tongue 64 which is preferably shaped identically to tongue 54 of the panel 14 (see FIG. 6). Trim strip 18 also includes a lower leg 66, which is substantially horizontal and defines a portion of a back 68 of the trim strip 18. A shoulder 69 adjacent tongue 64 also extends the entire length of trim strip 18.

Figure 3:
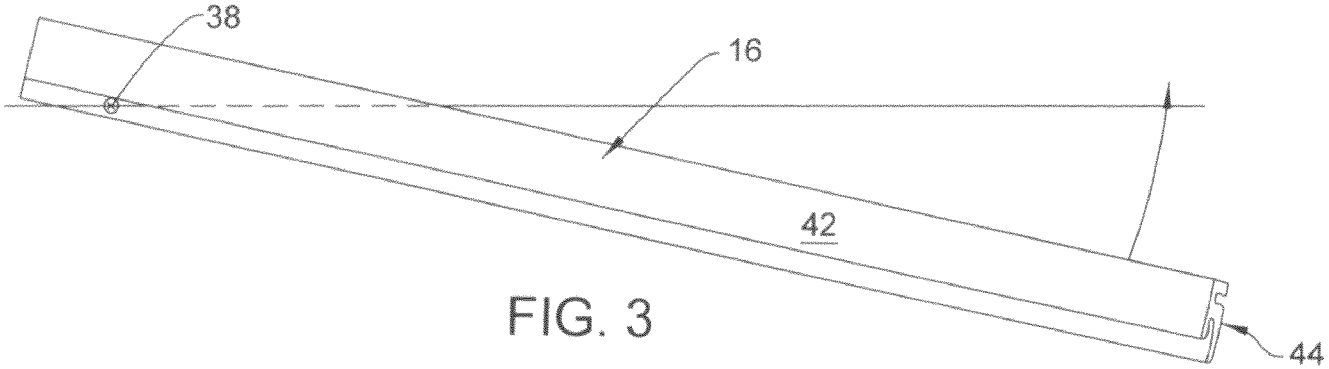
FIG. 3 is a perspective view showing a mounting strip for use with the present invention partially mounted on a wall.

FIGS. 3-6 show how the separate elements of the system are used to conveniently mount the panel system to a building structure. Referring to FIG. 3, the first step in mounting the panel system of the present invention is to attach upper mounting strip 16 to a wall or studs of a building structure. This is accomplished by attaching a first end of the mounting strip to the wall or stud by a fastener 38, such as a screw. Drywall screws can be used. The fasteners 38 may be driven through the material of the mounting strip 16 and do not require a prior hole. The fasteners 38 are driven through recessed portion 40 (see FIG. 5) and attached to the wall, or more preferably to a stud 100 which may be behind a wall 110 (see FIG. 6). After one end of mounting strip 16 has been attached to a wall or stud, a level 4 is used to orient the mounting strip 16 in a substantially horizontally level position. Thereafter, fasteners 38 are inserted in the middle and second end of the mounting strip 16 through recessed portion 40. The attachment by fasteners 38 secures the mounting strip 16 in position, which in turn assists in positioning the remaining portions of the wall system 10. Because the mounting strip 16 is relatively light, it is not difficult to hold the mounting strip 16 in position while it is being fastened. The mounting strip 16 thereafter is used to suspend the rest of the panel system 10.

Figure 4:
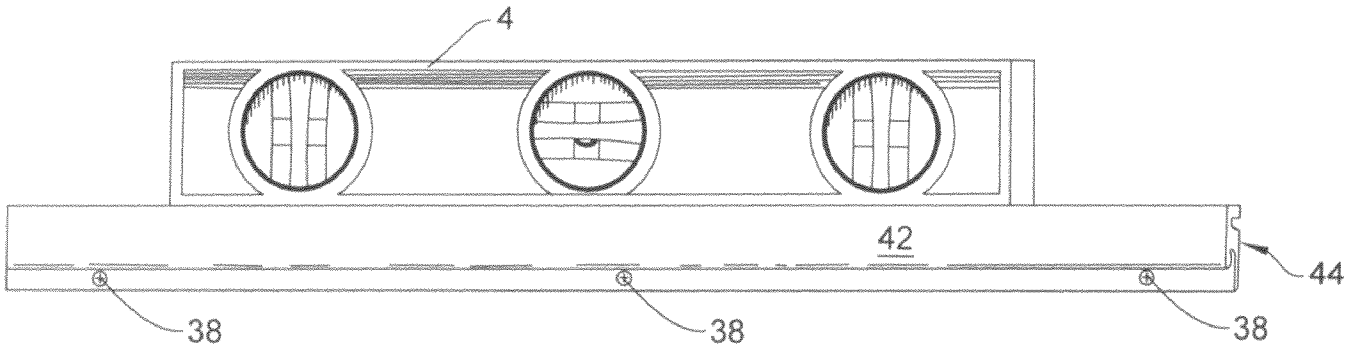
FIG. 4 is a perspective view showing the mounting strip of FIG. 3 mounted on a wall.

Once the mounting strip has been mounted in the manner shown in FIGS. 3-4, a wall panel 14 can be attached to and suspended from the mounting strip 16. Wall panels 14 are connected to the upper mounting strip 16 by placing panel 14 slightly below mounting strip 16, tilting the lower end of panel 14 away from the wall or stud, and moving panel 14 upwardly to move the head 60 of tongue 54 into groove 48. Tongue 54 fits snugly into arcuate groove 48 in the upper mounting strip 16. The lower end of the panel is then rotated into position against the wall, and when this is accomplished, the head portion 60 of the tongue 54 sits against or adjacent concave portion 50 and abuts convex portion 59 to prevent the panel from sliding downwardly out of the groove, thus effectively locking the panel 14 to the mounting strip 16. Once the tongue 54 is fully inserted into the groove 48, rear portion 61 of the panel 14 abuts the front of lower flange 50 and the shoulder 29 of panel 14 preferably abuts the lower front edge 43 of mounting strip 16. It is possible that shoulder 29 and lower front edge 43 do not abut upon attachment of panel 14 to mounting strip 16. If the shoulder 29 and the lower front edge 43 do not abut, there is only a minimal gap between them, which is substantially smaller, in the vertical direction, than groove 22.

When the slat wall panel 14 has been inserted into groove 48 and pivoted so as to be in contact with the wall or studs, as shown in FIG. 6, fasteners 38 are inserted through a recess 68 extending lengthwise adjacent the bottom edge of panel 14, in the same manner as recess 50. Fasteners 38 lock the bottom of the panel 14 in place. The upper portion of the panel 14 hides from view the fasteners 38 which hold mounting strip 16 to the wall or stud.

Lower trim strip 18 is then attached to panel 14 in the same way as panel 14 is attached to mounting strip 16. Lower trim strip 18 is placed slightly below panel 14, the lower portion of the lower trim strip tilted away from the wall or stud, and the lower trim strip 18 moved upwardly to locate tongue 64 directly under groove 63. A direction arrow 65, shown in FIG. 6, shows the general direction of insertion of tongue 64 into groove 63. The tongue 64 of lower trim strip 18 is inserted into groove 63 (which is shaped substantially the same as groove 48 in upper mounting strip 16) in the lower edge of panel 14. (See FIG. 6). Lower trim strip 18 is pivoted into abutting contact with the wall to lock the lower trim strip in place. Shoulder 69 preferably abuts the lower edge of panel 14, but abutment is not necessary. If there is not abutment between the shoulder 69 and the lower edge of panel 14, the gap there created is minimal and substantially smaller in the vertical direction than the size of grooves 22. Thus, lower trim strip 18 is held in place by the lower end of the panel 14 by a friction fit. Lower trim strip 18 hides fasteners 38 in panel 14 from view so that all of the fasteners are hidden.

Lower trim strip 18 does not have a fastener attaching it to the wall, but the tongue 64 and groove 63 in the trim strip 18 and panel 14, respectively, are formed so that they will be resiliently held together when pressed into position. The fasteners 38 may assist in holding the lower edge of the panel 14 in place. When fasteners 38 are pulled out slightly or screws are screwed out of their fully inserted position by about one half turn, the heads of the fasteners tend to provide a greater friction fit between tongue 64 and groove 63 when the lower trim strip 18 is fitted into position and pivoted into abutment with the wall or studs. This provides an advantage, because if another panel is to be mounted on the wall, the trim strip 18 can easily be removed by overcoming the friction fit and then fitting another panel into the groove 63 of the first panel. The trim strip 18 then attaches to the groove 63 of the second panel.

Figure 8:
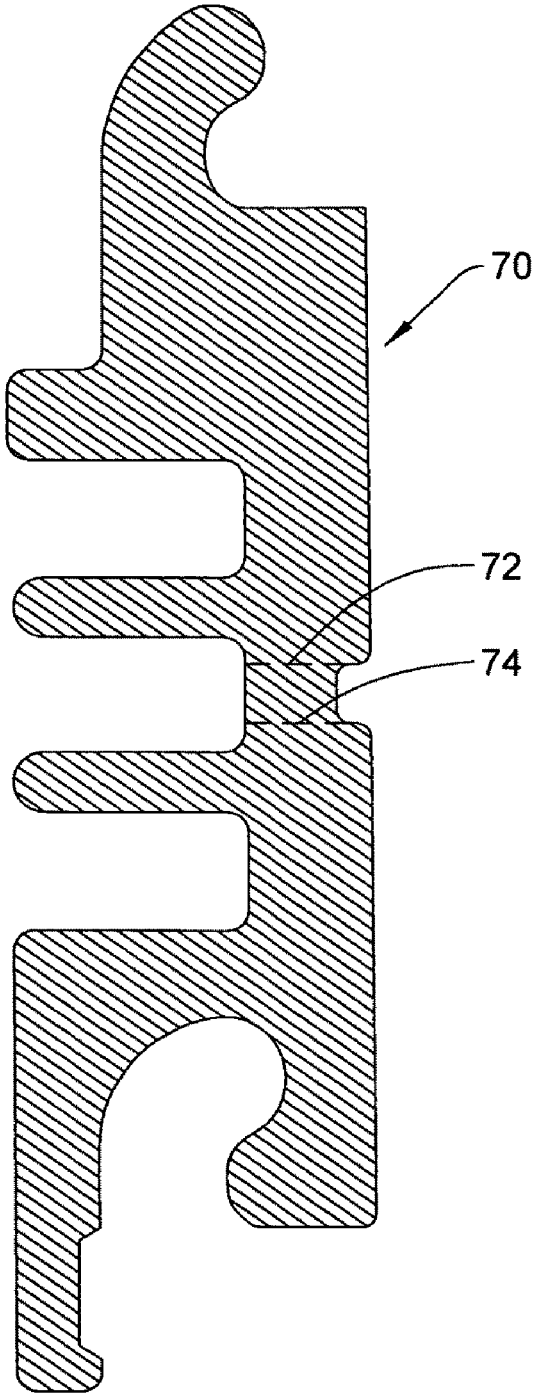
FIG. 8 is an edge elevational view of an extrusion from which both the mounting strip and lower trim strip may be made.

The upper mounting strip 16 and lower trim strip 18 can be extruded as a single unit 70 and separated by a saw into two parts along lines 72 and 74, as indicated in FIG. 8. This saves a significant amount of expense in tooling and fabrication of the parts.

Figure 9:
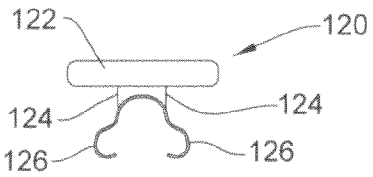
FIG. 9 is a side elevational view of a T-clip for insertion in a groove of a slat wall panel of the present invention.
Figure 9A:
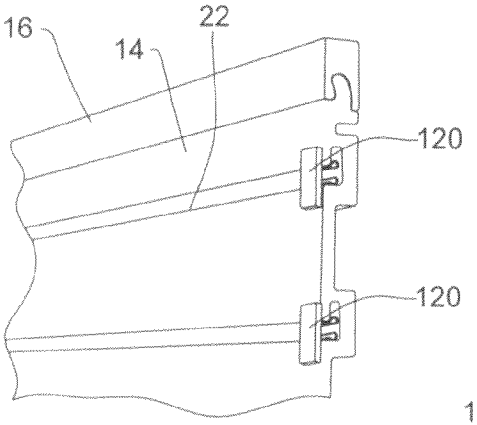
FIG. 9A is a slat wall of the present invention with T-clips of FIG. 9 inserted into grooves of the slat wall.

The wall system 10 of the present invention may also employ a finishing strip. A finishing strip 130 may be employed to provide a more desirable aesthetic appearance to a wall panel system. To use such a finishing strip, at least one T-clip 120 is inserted into a groove 22 of panel 14. (See FIG. 9-9A). The T-clip includes a head portion 122, a pair of legs 124 which extend downwardly from the head portion 122 and resilient curved feet 126 which extend from legs 124. T-clip 120 is placed into groove 22 by pressing the feet 126 against the edges of the groove 22 to bias the legs 124 toward each other slightly to allow the feet 126 to enter the groove, and then to rebound, thereby holding the T-clip in place.

Figure 10:
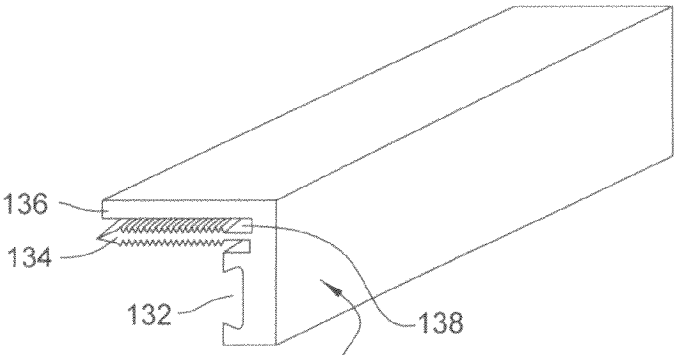
FIG. 10 is a perspective view of a finishing strip for finishing the sides of a wall panel system of the present invention.

The elongated finishing strip 130 may then be either slid or clipped onto the T-clip to hold it in place with respect to the remainder of panel system 10 to finish the edge of the panel system 10. Finishing strip 130 includes an elongated groove 132 adjacent the bottom of the finishing strip as finishing strip 130 is oriented and shown in FIG. 10. Groove 132 preferably extends the entire length of finishing strip 130. Above the groove 132 is a serrated member 134 and above that a finish member 136. Serrated member 134 and finish member 136 are spaced apart, creating a gap 138 therebetween.

Figure 12:
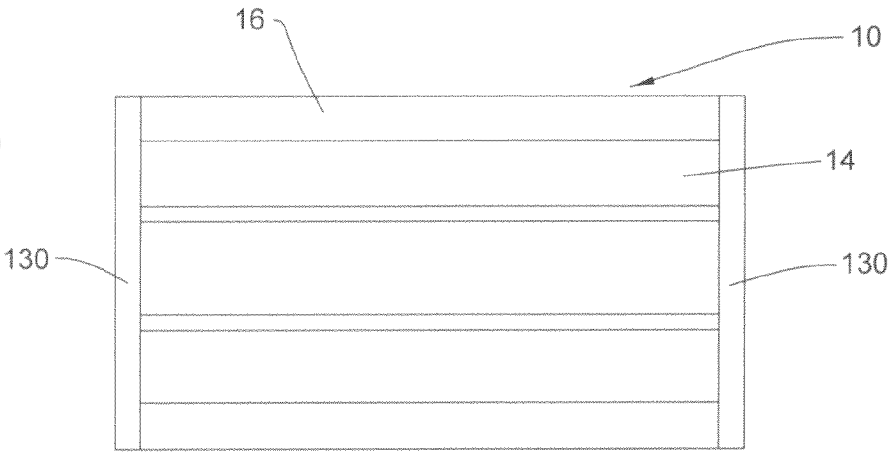
FIG. 12 is a finished slat wall system of the present invention.
Figure 11:
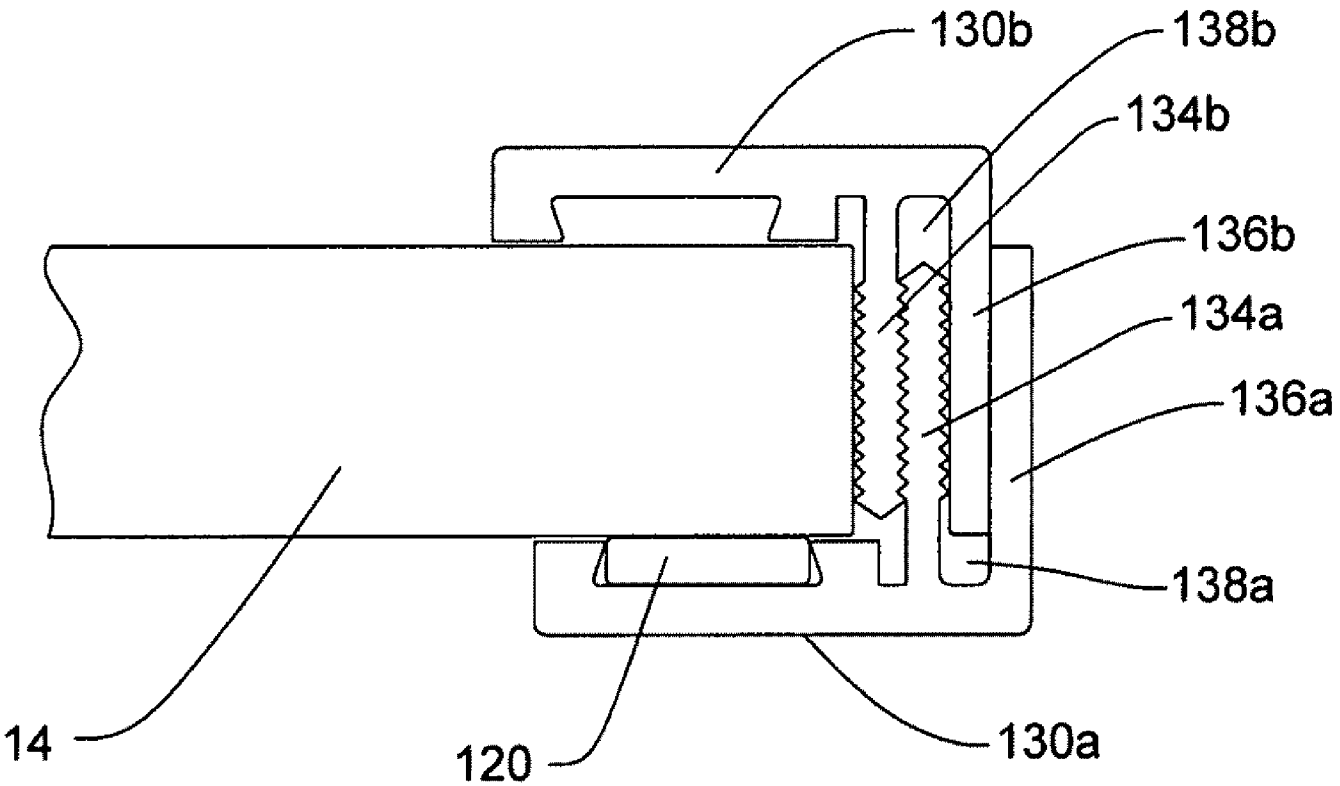
FIG. 11 is a top plan view of a portion of a wall panel system of the present invention employing two of the finishing strips of FIG. 10.

If the finishing strip 130 is used, a single strip 130 on each edge may be employed, or two strips may be used in tandem on each edge. To use two finishing strips 130 in tandem, as shown in FIG. 11, two finishing strips 130 are connected to each other by generally aligning a first finishing strip 130*a* and a second finishing strip 130*b* in the lengthwise direction but in mirror image fashion with respect to one another. The serrated member 134*a* of the first finishing strip 130*a* is inserted into the gap 138*b* of the second finishing strip, thereby also inserting the finish member 136*b* of the second finishing strip 130*b* into the gap 138*a* of the first finishing strip 130*a*. The serrations and friction among the various members of the two finishing strips 130 hold the two finishing strips in place with respect to one another, and one or more T-clips may be employed to attach the first finishing strip 130*a* to the panel 14 (see FIG. 11). The use of one or more finishing strips 130 on the sides of the panel system 10 creates a framed look with respective finishing strips 130 on the sides of the panel system 10 and the mounting strip 16 and lower trim strip 18 creating the upper and lower frame portions, respectively, as shown in FIG. 12.

Figure 14:
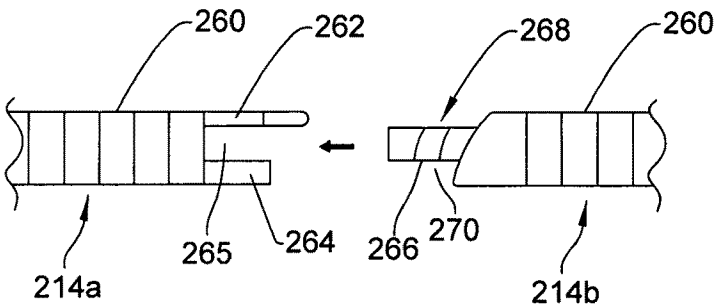
FIG. 14 is a top plan view of portions of two smooth wall panels of the present invention.
Figure 13:
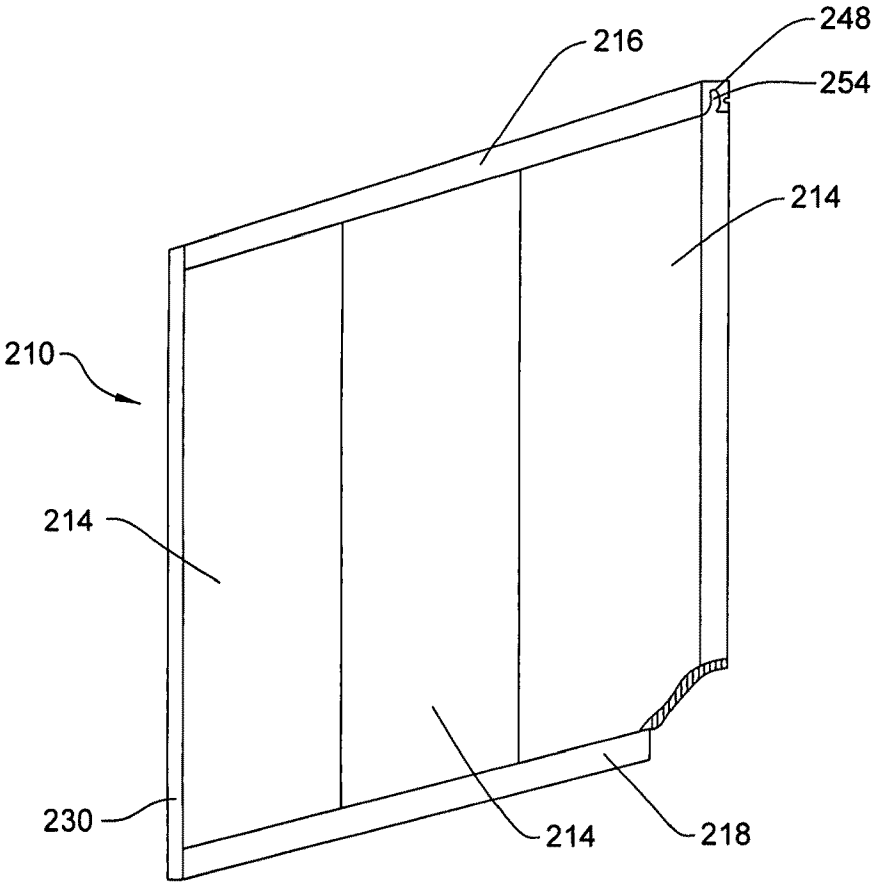
FIG. 13 is a portion of a smooth wall system of the present invention, with a cut-out corner portion.

As described above, the attachment system of the present invention may be employed with a smooth wall panel, that is, a slatless wall panel. The smooth wall system uses the same tongue and groove attachment system described above, but the panels themselves may also be attached to one another along a vertical attachment apparatus. As shown in FIG. 13, the smooth wall panel system 210 includes one or more panels 214, an upper mounting strip 216, and a lower trim strip 218. The smooth wall panel system 210 also preferably includes a finishing strip 230 on each side of the smooth wall panel system 210. The smooth wall system 210 is constructed in similar fashion to the above-described slat wall system 10. An upper mounting strip 216—virtually identical, although preferably smaller, to that of mounting strip 16—is attached to the building structure by use of fasteners. One or more panels 214 are then attached to both the mounting strip 216 and to the wall. The panels 214 are attached to the mounting strip 216 in the same fashion as with the slat wall system 10 described above. A tongue 254 extending from the upper edge of the panels 214 is inserted into groove 248 of mounting strip 216 by tilting the bottom of the panel outward, inserting the tongue 254 into groove 248, and then tilting the bottom edge of the panel 214 toward the wall. The panels are then also preferably attached, such as by staples, to the wall along a rear vertical flange 262 (see FIG. 14).

On a first side of the panel, in addition to the rear flange 262, the panels 214 include a front flange 264 which is shorter in the horizontal direction than the rear flange 262. Flanges 262 and 264 extend, preferably along the entire vertical length of panel 214, from a body 260 of the panel 214 and are spaced apart from one another leaving a gap 265 therebetween. On a second opposite side of panel 214, at least one leg 266 extends from the body 260 of the panel 214. The leg 266 is substantially centrally located front to back, and thus leaves a rear space 268 and a front space 270 adjacent the leg 266.

To attach an additional panel when a first panel 214 has been installed, a second panel 214*b* is first attached to the mounting strip 216 in a location adjacent the first installed panel 214*a* by insertion of the tongue 254 of the second panel 214*b* into the groove 248 of the mounting strip 216 and then sliding the second panel 214*b* horizontally toward the first panel 214*a* to attach to the first panel 214*a* by friction fit. To attach a second panel to a first installed panel, the second panel 214*b* is slid toward the first panel 214*a*, inserting leg 266 into gap 265, and the flanges 262 and 264 occupy the rear space 268 and the front space 270, respectively, adjacent leg 266. The insertion of leg 266 into gap 265 creates a friction fit between the panels. The second panel 214*b* is then preferably attached to the wall by stapling through the rear flange 262 of the second panel into the wall. Once the desired number of panels are inserted and attached to both the mounting strip 216 and the wall in this fashion, a second finishing strip 230 is preferably attached and a lower trim strip 218 is attached to finish the smooth wall panel system 210.

Figure 15:
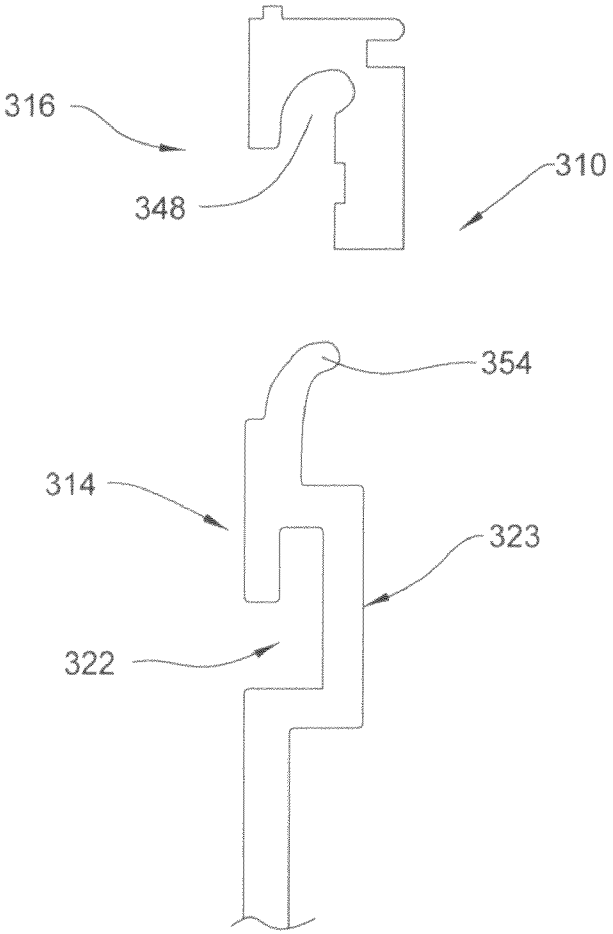
FIG. 15 is a partial side elevational view of another embodiment of a panel slat wall system of the present invention.

FIG. 15 shows another embodiment of a wall panel system. The wall panel system 310 of FIG. 15 includes a panel 314 with an upwardly extending tongue 354, and a mounting strip 316 with a groove 348. Tongue 354 and associate groove 348 are opposite in direction with respect to the tongue 54 and groove 48 of the panel system 10. In other words, as the tongue 354 and groove 348 extend upwardly, they curve toward back side 323 of panel system 10. Because panel 314 cannot be tilted beyond the vertical plane of the wall or studs to which the panel system is to be attached in most cases, tongue 354 is thin enough to bend and snap into place in groove 348. The attachment of panel 314 to mounting strip 316 preferably creates no gap at their juncture, or only a minimal gap that is substantially smaller vertically than the size of a slat 322 in panel 314.

The panel system of the present invention provides many advantages. The system is easily and quickly installed with a minimum of tools, and may be installed by a "do-it-yourself" homeowner. Yet, the size and shape of the panel system creates a large load-bearing ability, and may be installed over a large area. The sides and ends are clean and aesthetically pleasing, due to the mounting strip abutting (or closely adjacent) the panel, by the use of finishing strips, and due to a structure whereby all fasteners are hidden. The finishing strips of the present invention may likewise be quickly installed and are attached directly to the panels, creating a clean, framed look of the wall panel system.

It should be understood that various changes and arrangements may be made in the foregoing construction without departing from the spirit and scope of the present invention.

What is claimed is:

1. A method of installing a wall panel system, the method comprising the steps of:

(a) providing a mounting strip having a length, a strip front face, a strip back, an upper edge, a front lower edge adjacent the strip front face, a strip bottom, and a first groove therein, the first groove extending the entire length of the mounting strip and extending upwardly from the strip bottom and curving toward the strip front face as the groove extends upwardly from the strip bottom;

(b) providing a panel having a panel front face, a panel back, an upper end, a lower end, and a curved tongue extending upwardly from the upper end and toward the panel front face as the tongue extends upwardly from the upper end, the upper end defining a shoulder adjacent the panel front face;

(c) mounting the mounting strip to a structure, an extension of the strip back being located in a vertical plane after mounting;

(d) locating the panel adjacent the mounting strip such that the tongue of the panel is adjacent to the groove of the mounting strip and locating the lower end of the panel away from the vertical plane;

(e) inserting the tongue into the groove of the mounting strip such that the shoulder of the panel abuts the front lower edge of the mounting strip; and (f) tilting the lower end of the panel toward the vertical plane until the panel back is located substantially in the vertical plane.

2. The method of installing a wall panel system according to claim 1, wherein the panel comprises a plurality of slats and a plurality of slat grooves.

3. The method of installing a wall panel system according to claim 2, wherein the method results in an installed panel system having a gap between the shoulder of the panel and the lower edge of the mounting strip, the size of the gap being substantially smaller in the vertical direction relative to the size of an individual slat groove of the panel.

4. The method of installing a wall panel system according to claim 1, wherein the panel is a smooth wall panel.

5. The method of installing a wall panel system according to claim 1, wherein the method results in an installed panel system, and the shoulder of the panel abuts the front lower edge of the mounting strip in the installed panel system.

6. The method of claim 4, wherein the smooth wall panel is a first smooth wall panel and further comprising the steps of:

(g) providing a second smooth wall panel having an upper end, a lower end, a back, and a curved tongue extending upwardly from the upper end;

(h) locating the second smooth wall panel adjacent the first smooth wall panel and the mounting strip, and locating the lower end of the second panel away from the vertical plane;

(i) inserting the curved tongue of the second smooth wall panel into the first groove of the mounting strip;

(j) tilting the lower end of the second smooth wall panel toward the vertical plane until the back of the second smooth wall panel is located substantially in the vertical plane; and (k) attaching the second smooth wall panel to the first smooth wall panel.

7. The method of claim 6, wherein the step of attaching the second smooth wall panel to the first smooth wall panel includes sliding the second smooth wall panel in a substantially horizontal direction.

8. A slat wall system comprising:

a mounting strip having a length, a front face, an upper edge, a back, a lower end, and a first groove therein, the first groove extending the entire length of the mounting strip and extending upwardly from the lower end of the mounting strip, curving toward the front face as the groove extends upwardly so as to be arcuate in shape; and a panel having a front face, at least one raised slat forming at least a portion of the front face of the panel, an upper end, a lower end, a curved tongue extending upwardly from the upper end and toward the front face of the panel as the tongue extends upwardly, and at least one mounting groove adjacent the front face of the panel, the tongue of the panel being inserted into the first groove at a mating location so as to attach the panel to the mounting strip without the creation of a groove at or adjacent the tongue and first groove mating location, the mounting groove of the panel having a different shape than the first groove of the mounting strip, the panel having a side, and further comprising a clip attached to the mounting groove at a location adjacent the side of the panel, and a finishing strip attached to the clip.

9. A wall system comprising:

an upper mounting strip having a longitudinal axis and comprising a front having a lower lip with a bottom, a back, a lower flange defining at least a portion of the back, an arcuate groove disposed between the front and the back, and a first recess in the lower flange, the first recess extending below the bottom of the lower lip when the longitudinal axis is oriented horizontally;

a panel attached to the upper mounting strip, the panel comprising a panel front, a panel back, a panel longitudinal axis, an upper end, a lower end, a curved tongue extending from the upper end of the panel, a shoulder at the upper end of the panel abutting the lower lip of the upper mounting strip, a bottom edge adjacent the panel front, and a lower panel flange adjacent the panel back and extending below the bottom edge when the panel longitudinal axis is oriented horizontally, the curved tongue received by the arcuate groove of the upper mounting strip.

10. The wall system of claim 9, wherein the panel is a slat wall panel.

11. The wall system of claim 9, wherein the panel is a smooth wall panel.

12. The wall system of claim 11, wherein the smooth wall panel comprises an attachment apparatus for attaching the smooth wall panel to another wall panel.

13. The wall system of claim 9, and further comprising a lower trim strip comprising a tongue attached to the panel.

14. The wall system of claim 10, wherein the slat wall panel comprises a plurality of slats and a plurality of mounting grooves.

15. The wall system of claim 9, wherein the panel has a side and a mounting groove, and further comprising a clip attached to the mounting groove adjacent the side of the panel, and a finishing strip attached to the clip.

16. The wall system of claim 9, wherein the upper mounting strip and the panel are of PVC.

17. The wall panel of claim 11, wherein the panel is a first panel and further comprising a second panel which can be horizontally slid into attachment with the first panel.

* * * * *